US008287247B2

(12) United States Patent
Bonucci et al.

(10) Patent No.: US 8,287,247 B2
(45) Date of Patent: Oct. 16, 2012

(54) COMBINED PUMPING SYSTEM COMPRISING A GETTER PUMP AND AN ION PUMP

(75) Inventors: Antonio Bonucci, Milan (IT); Andrea Conte, Milan (IT); Paolo Manini, Milan (IT)

(73) Assignee: SAES Getters S.p.A., Lainate (MI) (IT)

( * ) Notice: Subject to any disclaimer, the term of this patent is extended or adjusted under 35 U.S.C. 154(b) by 0 days.

(21) Appl. No.: 13/202,890

(22) PCT Filed: Mar. 9, 2010

(86) PCT No.: PCT/EP2010/052975

§ 371 (c)(1),
(2), (4) Date: Sep. 15, 2011

(87) PCT Pub. No.: WO2010/105944

PCT Pub. Date: Sep. 23, 2010

(65) Prior Publication Data

US 2012/0014814 A1 Jan. 19, 2012

(30) Foreign Application Priority Data

Mar. 17, 2009 (IT) ..... MI2009A0402

(51) Int. Cl.
*F04B 37/02* (2006.01)
*F04F 99/00* (2009.01)

(52) U.S. Cl. ..... 417/49

(58) Field of Classification Search ..... 417/48, 417/49

See application file for complete search history.

(56) References Cited

U.S. PATENT DOCUMENTS

| | | | | |
|---|---|---|---|---|
| 2,993,638 | A * | 7/1961 | Helmer et al. | 417/49 |
| 3,327,929 | A | 6/1967 | Dillenbeck et al. | |
| 3,377,499 | A | 4/1968 | Lloyd | |
| 5,221,190 | A | 6/1993 | Romer et al. | |
| 5,324,172 | A | 6/1994 | Manini et al. | |
| 5,993,165 | A | 11/1999 | Lorimer et al. | |
| 6,074,171 | A * | 6/2000 | Giannantonio et al. | 417/51 |
| 6,149,392 | A * | 11/2000 | Conte | 417/51 |
| 6,309,184 | B1 * | 10/2001 | Moraja et al. | 417/51 |
| 7,635,943 | B2 * | 12/2009 | Kamio et al. | 313/7 |
| 2006/0231773 | A1 | 10/2006 | Katagiri et al. | |

FOREIGN PATENT DOCUMENTS

| | | |
|---|---|---|
| EP | 0719609 | 3/1996 |
| GB | 2164788 | 3/1986 |
| JP | 58-117371 | 7/1983 |

(Continued)

OTHER PUBLICATIONS

PCT International Search Report issued for PCT Application No. PCT/EP2010/052975 filed Mar. 9, 2010 in the name of SAES Getters.

(Continued)

*Primary Examiner* — Devon Kramer
*Assistant Examiner* — Bryan Lettman
(74) *Attorney, Agent, or Firm* — Steinfl & Bruno LLP

(57) ABSTRACT

A combined pumping system comprising a getter pump and an ion pump is described. The getter pump and the ion pump are mounted in series on a same flange and are respectively arranged on opposite sides thereof so that both getter and ion pumps conductance are maximized towards gas flux sources in a vacuum chamber in order to improve the vacuum level of the system.

11 Claims, 4 Drawing Sheets

FOREIGN PATENT DOCUMENTS

Figure 1:
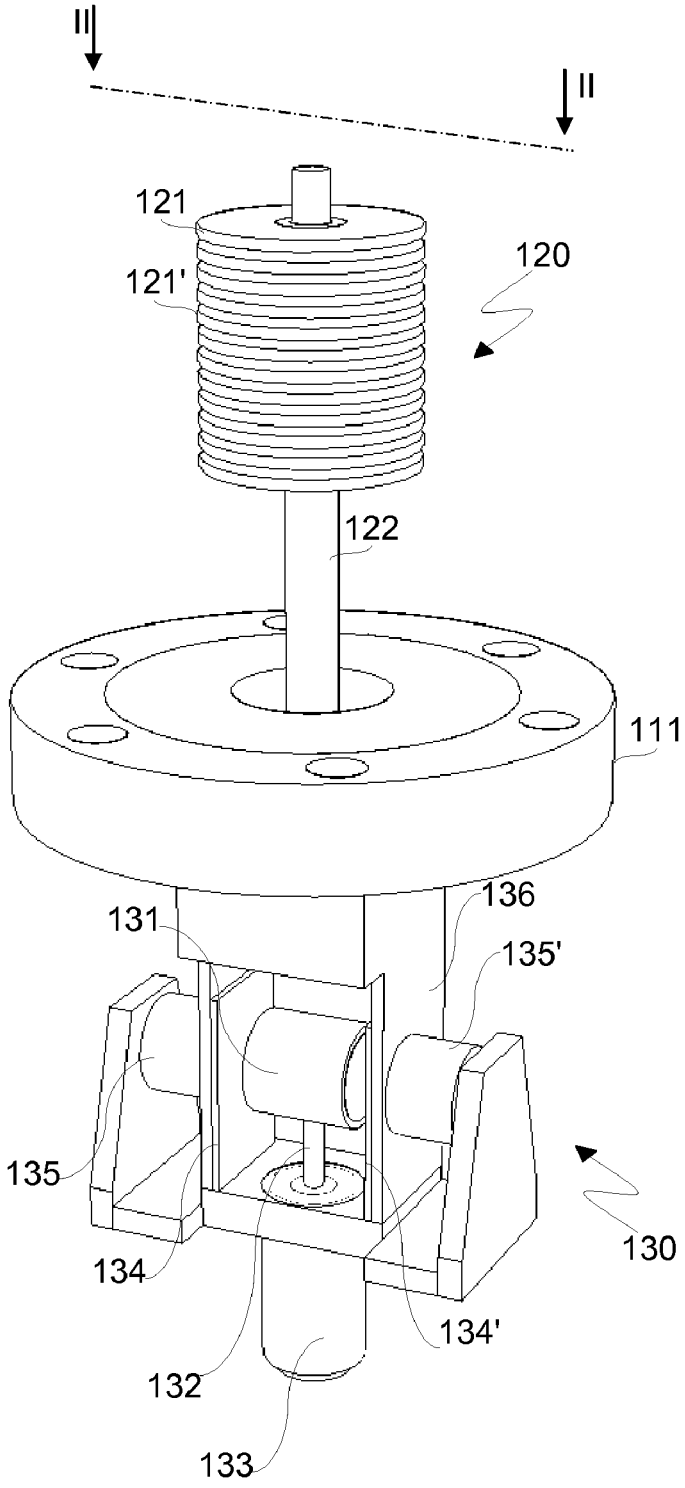

| | | |
|---|---|---|
| JP | 2007263198 | 11/2007 |
| WO | 98/58173 | 12/1998 |
| WO | 00/23173 | 4/2000 |
| WO | 00/23713 | 4/2000 |
| WO | 2009/118398 | 10/2009 |

OTHER PUBLICATIONS

PCT Written Opinion issued for PCT Application No. PCT/EP2010/052975 filed Mar. 9, 2010 in the name of SAES Getters.

PCT International Preliminary Report on Patentability issued for PCT Application No. PCT/EP2010/052975 filed Mar. 9, 2010 in the name of SAES Getters.

O'Hanlon, J., High Vacuum Systems, Chapter 20, A User's Guide to Vacuum Technology 2003, 379-402.

O'Hanlon, J., Getter and Ion Pumps, Chapter 14, A User's Guide to Vacuum Technology 2003, 247-262.

Kelly, D., Dust in accelerator vacuum systems, IEEE 1998, 3547-3551.

Welch, et al., Pumping of helium and hydrogen by sputter-ion pumps. II hydrogen pumping, J. Vac. Sci. Technol. A 1994, 12: 861-866.

* cited by examiner

COMBINED PUMPING SYSTEM COMPRISING A GETTER PUMP AND AN ION PUMP

CROSS REFERENCE TO RELATED APPLICATIONS

The present application is the US national stage of International Application PCT/EP2010/052975 filed on Mar. 9, 2010 which, in turn, claims priority to Italian Application MI2009A000402, filed on Mar. 17, 2009.

The present invention relates to a combined pumping system that comprises a getter pump and an ion pump.

There are numerous scientific and industrial instruments or systems, as for example particle accelerators and electronic microscopes, whose operation requires ultra-high vacuum conditions (indicated in the field as UHV), i.e. pressure values lower than $10^{-6}$ Pa. Pumping systems comprising a pump that is defined primary, for example a rotating or a membrane pump, and a secondary pump selected between a turbomolecular, getter, ion or cryogenic pump are generally used to create these vacuum levels. The primary pump starts to operate at atmospheric pressure and can bring the pressure inside the chamber down to values of about $10^{-1}$-$10^{-2}$ Pa; at these pressures the UHV pump is activated, bringing the pressure in the system down to values of about $10^{-7}$-$10^{-9}$ Pa.

Among the UHV pumps that are most common, ion and turbomolecular ones can sorb almost all gases.

Turbomolecular pumps are appreciated because of their reduced (even if not null) oil contamination of the vacuum chamber in comparison with other mechanical pumps, but the effective ultimate vacuum value is related to the rather low compression ratio for light gases (hydrogen and helium) and to the possible introduction of small quantities of these gases from the external environment through the pump itself.

Ion pumps, instead, have no moving parts and oil so they are characterized by a very clean low-maintenance and by a better insulation from the external environment. Moreover they can provide an approximate indication of the pressure value inside the evacuated chamber. This characteristic is particularly appreciated by manufacturers and users of vacuum instruments, because it allows to monitor the conditions of the system and to interrupt the pump operation when the pressure inside the chamber increases up to critical values.

Ion pumps are comprised of a set of a plurality of members equal to each other. In each one of these members, ions and electrons are generated from the gases present in the chamber by means of high electric fields; a magnet arranged around each member provides the electrons with a non-straight trajectory (generally a helical trajectory) so as to enhance their ability to ionize other molecules present in the chamber. The ions so produced are trapped by the walls of the member partially through ion implantation into the walls and partially due to a burial effect under the titanium layers formed through atoms (or atoms "clusters") generated by the erosion of the walls after ion bombardment and re-deposited. Titanium has also an inherent gettering ability, i.e. it is a metal able of interacting with simple gaseous molecules fixing them through the formation of chemical compounds.

A problem of ion pumps is represented by the possibility of generating hydrogen as effect of the dissociation of methane, this being a phenomenon that can involve difficulties in achieving the desired vacuum conditions, i.e. to reach pressures of the system lower than values of about $10^{-8}$-$10^{-9}$ Pa, as described in the scientific publication "Pumping of Helium and Hydrogen by Sputter-Ion Pumps. II. Hydrogen Pumping", by K. L. Welch et al. published in J. Vac. Sci. Technol. A, American Vacuum Society, 1994, page 861. The generation of hydrogen and other undesired gaseous species results in the presence of a collimated molecular flux from the ion pump towards the vacuum chamber, generally known as "beaming effect".

A second kind of problem may consist in the casting of dust particles into the beam pipe for some applications as described in the scientific publication "Dust in Accelerator Vacuum Systems", by D. R. C. Kelly published in the Proceedings of the Particle Accelerator Conference, 1997. vol. 3 page 3547.

Other not secondary limits of ion pumps are their relatively large size and weight which make their application in compact or portable systems difficult.

These problems are particularly important for applications such as electronic microscopes, particle accelerators and surface analysis systems.

Getter pumps operate on the basis of the principle of the chemical sorption of reactive gaseous species such as oxygen, hydrogen, water and carbon oxides by elements made of non-evaporable getter materials (known in the field as NEG). The most important NEG materials are zirconium or titanium based alloys; getter pumps are described for example in patents U.S. Pat. Nos. 5,324,172 and 6,149,392. These pumps have, on equal size, a gas sorbing speed that is remarkably higher than the sorbing speed of ion pumps and can remove hydrogen much more effectively than these ones; opposite to these advantages, the pumping efficiency of getter pumps is poor in the case of hydrocarbons (such as for example methane at ambient temperature) and null in the case of rare gases. Moreover, getter pumps cannot provide a measure of the pressure inside the chamber.

In order to improve pumping in a UHV chamber, the combined use of different secondary pumps may overcome the above-described limits.

The use of a getter pump upstream with respect to a turbomolecular pump is disclosed in the International Patent publication WO 98/58173. This application teaches the combination of a turbomolecular and a particular getter pump in order to overcome efficiency, conductance and thermal drawbacks of upstream configurations, strictly related to the mechanical structure of the first pump. A strong limit of the disclosed solution is the requirement of a special getter pump, suitably manufactured to be used with turbomolecular pumps. In fact a zigzag-shaped wire is proposed as gettering element to overcome the technical problems observed in the use of a NEG pump of standard production. The use of a less expensive and more efficient getter pump is therefore not possible in the disclosed combined pumping system.

WO 00/23173 describes the use of a getter pump and a turbomolecular pump in line to each other. Pumps have an "in series" configuration with respect to the vacuum chamber and they need the use of a temperature responsive mobile shielding device in order to limit the heat transfer from the getter pump and the turbomolecular one. The use of the disclosed shielding member allows to minimize the reduction of the gas flow conductance to the turbomolecular pump, but the overall conductance for the combined pumping system is anyway limited by the hole that connects the system to the vacuum chamber and, for the turbomolecular pump, by the effective volume that is occupied by the getter pump in the duct.

The combined use of ion pumps and getter pumps provides particularly efficient pumping systems for UHV. In a combined pumping system ion and getter pumps may be arranged in parallel or in series, such as described for example in the scientific publication "Foundation of Vacuum Science and Technology" by M. Lafferty, published in 1998 by Wiley-Interscience, John Wiley & Sons.

These pumping systems have been disclosed for example in the patent application JP 58-117371 or patent U.S. Pat. No. 5,221,190 relating to vacuum systems as such and from patent applications JP-A-06-140193 or JP-A-07-263198 relating to particle accelerators whose chamber is kept evacuated by using separated ion and getter pumps.

The combined pumping systems described in all these documents are based on the use of an ion pump as main pump and of a getter pump as auxiliary pump having a smaller size. Hence, these documents do not solve the main problems related to the use of ion pumps, i.e. their large weight, size, energy consumption and above all the lower limits of the pressure of the vacuum chamber that are related to the previously described degassing phenomenon.

Moreover, these documents disclose the introduction of the getter pump into recesses in the vacuum chamber walls so that its pumping efficiency and the conductance values are reduced if compared to its arrangement directly inside the vacuum chamber volume.

Patent application US 2006/0231773 describes an electronic microscope wherein the vacuum system comprises an ion pump and a getter pump and wherein the getter pump is used as the main pump and a relatively small ion pump is used as an auxiliary pump in order to block the gases that are not sorbed by the getter pump. This system allows to reduce the weight and the size of the vacuum system, but, similarly to the previous cases, it is characterised by two separate pumps that still have a remarkable size with respect to the whole system. Moreover, it is known that a critical point in UHV systems is the number of the apertures formed on the wall of the chamber. In fact, due to possible non-perfect seals at a microscopic level of flanges, gaskets or brazing materials (in particular in the case of systems that are heated and wherein different thermal dilations of parts made of different materials occur), these apertures may represent preferential points of the vacuum condition degradation. The two-pump system described in patents application US 2006/0231773 needs two different access points from the outside in order to supply the ion pump and the getter pump (or more than two if e.g. the system comprises more than one ion pump) and hence it is not the optimum from the point of view of the manufacturing of a system that must operate under ultra-high vacuum conditions.

The International Patent publication WO 2009118398 in the applicant's name describes combined pumping systems comprising at least one ion pump having a reduced size and one getter pump arranged at different locations of a common flange. In this way it is possible to use a single aperture along the wall of the chamber, thus simplifying the structure of the system and limiting its tightness problems. However, these pumping systems are based on configurations in parallel of the two pumps which do not allow an effective limit to the degassing flux generated by the operation of the ion pump towards the chamber to be evacuated. In particular, the flux of hydrogen and other undesired chemical species coming out from the ion pump because of dissociation phenomena can constitute a strong limiting factor in the aim of achieving the low pressure value.

The degassing flux generated by the ion pump during its operation may be reduced by using a configuration in series of the ion pump with the getter pump. Patent GB 2164788 describes, for example, a combined pumping system wherein a getter pump and an ion pump are arranged in series. In particular, the getter pump is arranged inside a duct that connects the ion pump with the chamber to be evacuated. A problem of the pumping system of the above-mentioned patent is that each one of the pumps influences the pumping of the other one, thus resulting in a reduction of the conductance for the gas flow from the chamber to be evacuated. In fact, the arrangement of the getter pump inside the duct connecting the flange aperture to the ion pump inevitably results in a reduction of the gas flux from the chamber to be evacuated towards the ion pump. Moreover, the gas flux from the chamber towards the getter pump is limited by the size of the hole of the above-mentioned duct.

Patent GB 2164788 discloses also, as possible alternative arrangement, the getter pump positioning in a seat along the side walls of the duct between the aperture of the ion pump and the vacuum chamber. This configuration limits the negative effects of conductance reduction for the ion pump, but it results in a reduction of the gas flux towards the getter pump and thus in a lower efficiency in terms of conductance.

It is therefore an object of the present invention to provide a combined pumping system being able to overcome the disadvantages of the prior art.

Said object is achieved, according to the present invention. with a combined pumping system comprising a getter pump and an ion pump mounted in series and on opposite sides of a flange suitable to mount the combined pumping system to a vacuum chamber, characterized in that the ion pump is connected to the flange by a duct and said getter pump is external to said duct.

The inventors have found that the combination of the ion pump and the getter pump according to the present invention allows to obtain and keep ultra-high vacuum conditions inside the chamber providing both the advantages of a "in parallel" pump configuration and an "in series" one. Similarly to an arrangement "in series", in fact, the invention allows the getter pump to effectively sorb the collimated molecular flux generated by the ion pump while, similarly to an "in parallel" configuration, the arrangement on opposite sides of the flange allows the pumping of the gases from the vacuum chamber by both the two pumps without the reduction of their conductances.

Figure 2:
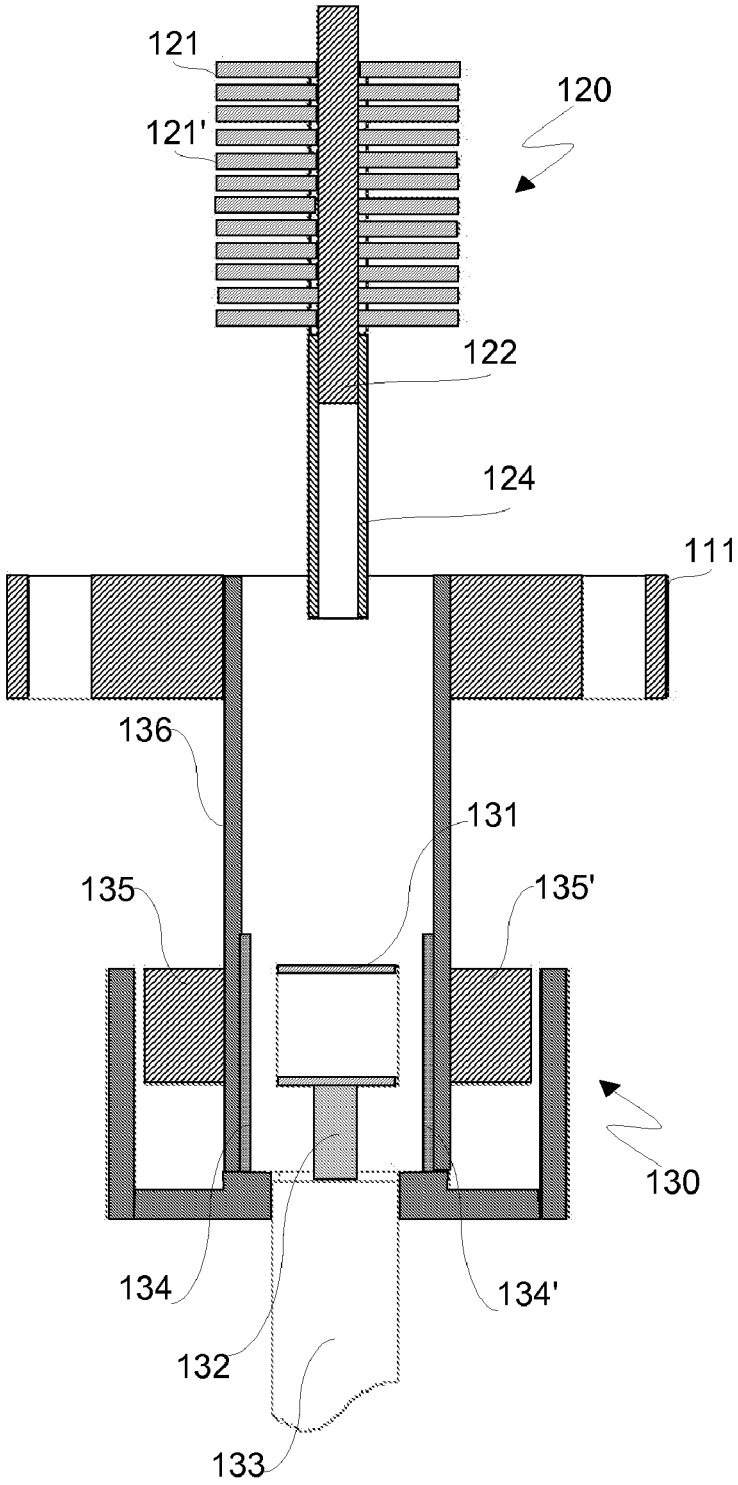
Figure 2A:
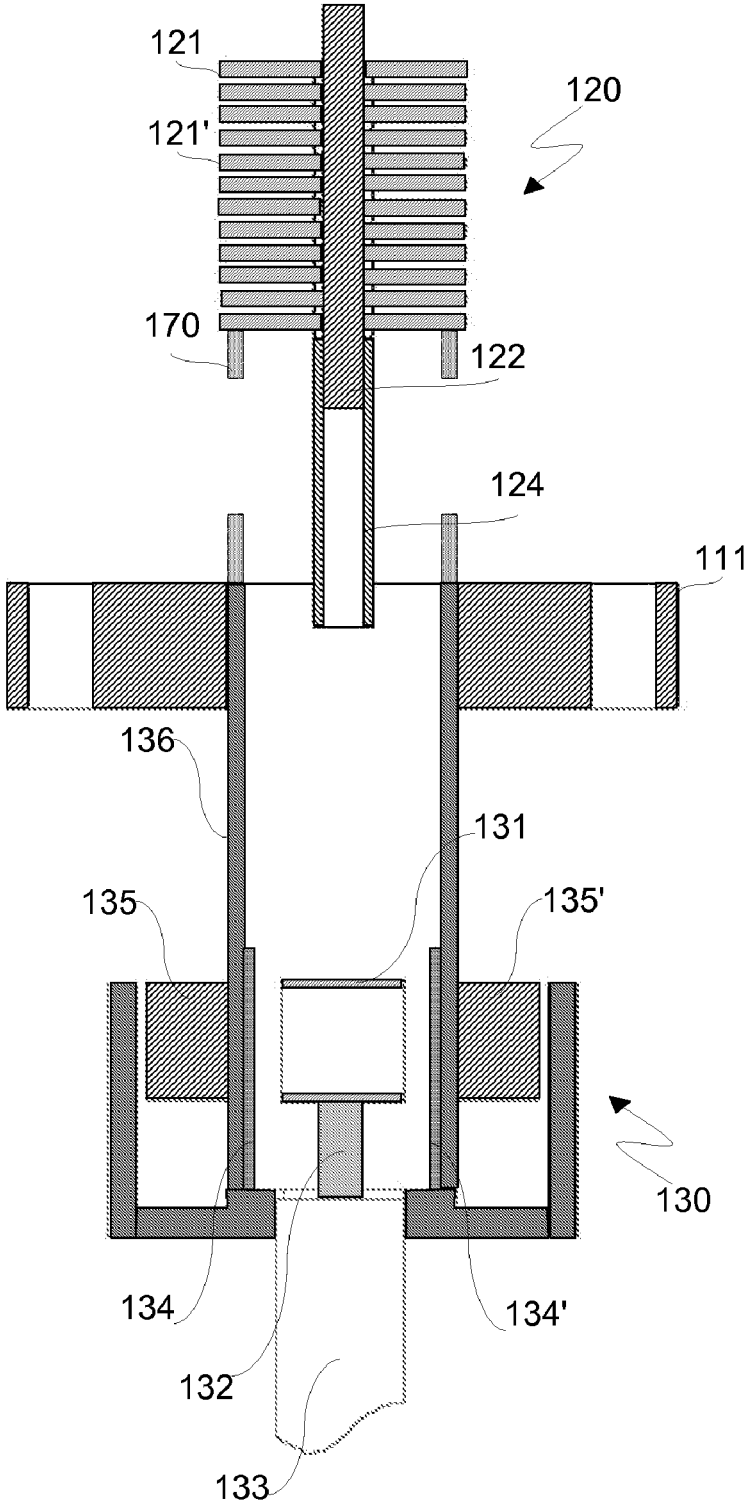
Figure 3:
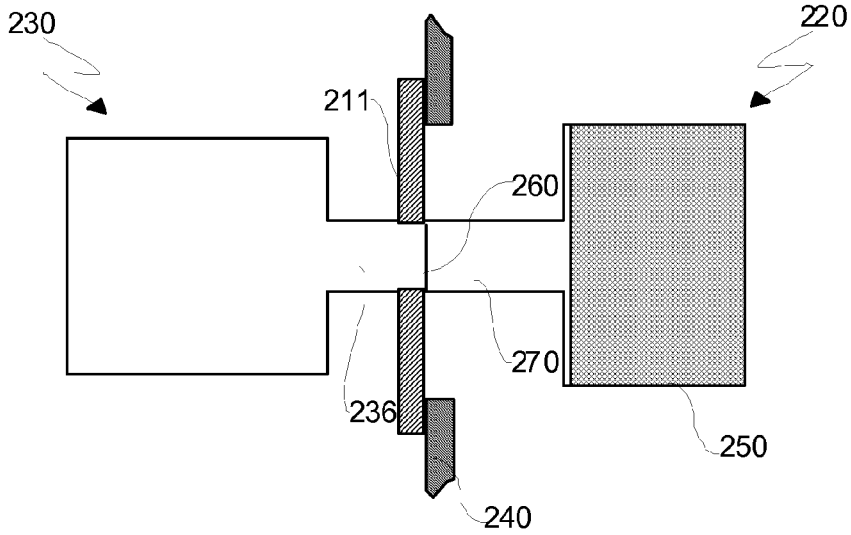
Figure 4:
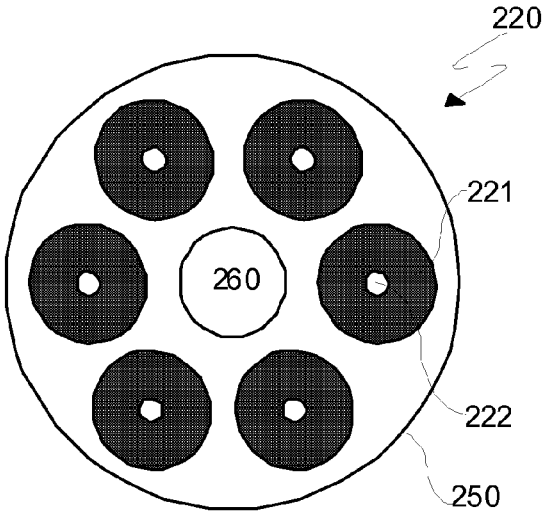

The invention will be described in detail in the following with reference to the drawings, wherein:

FIG. 1 shows a schematic perspective view of a first embodiment of the pumping system according to the present invention;

FIGS. 2 and 2*a* are longitudinal cross-section views along the plan defined by line II-II of the system shown in FIG. 1, respectively without and with a connecting duct between the getter pump and the flange hole;

FIG. 3 schematically shows a lateral view of an alternative embodiment of the pumping system according to the present invention; and FIG. 4 is a top view showing a possible configuration of different structures of getter members inside the getter pump used in the combined system according to the invention.

All the drawings are shown in a schematic and simplified form in order to allow a better understanding thereof, thus not indicating details such as electric connections nor respecting the real geometric proportions of the different members forming the system and their physical coupling. These details and their possible variants can be easily determined by a person skilled in the art.

FIGS. 1 and 2 schematically show a first embodiment of the pumping system according to the invention in its simplest configuration. The system comprises a flange 111 suitable for its direct mounting on a vacuum chamber wall, flange on which a getter pump 120 and an ion pump 130 are respectively connected to opposite sides of this flange and the getter pump physically intercepts the symmetry axis of the hole of the flange. In order to simplify them, all the figures show the invention in its preferred embodiment, i.e. coaxially mounted with respect to the symmetry axis of the flange.

The flange therefore is connected to both the pumps and can be used to connect the combined system to the vacuum chamber wall, resulting in an arrangement characterized by the positioning of the ion pump externally to the chamber volume, whereas the getter pump is allocated internally to this chamber and not in a duct or in a lodging on one of its walls. Moreover, the getter pump arrangement is preferred if the volume occupied by it intercepts the axis of the flange hole, defined as the rotational axis of symmetry of the flange hole itself.

The getter pump 120 may be built by elements made of NEG material, have various shapes and be assembled according to different geometries; moreover, it may comprise metal shields (e.g. in the form of meshes or at least partially perforated or opened thin plates) arranged around the set of members of NEG material in order to protect it and avoid incidental losses of metal particles, being possible with awkward assembling operations inside the vacuum system in which the pump has to be used.

In FIGS. 1 and 2, the getter pump 120 is made up of a series of discs of NEG material, 121, 121', . . . , stacked by a central support 122 and kept spaced by e.g. metal rings (not shown in FIG. 1). The central support 122, made e.g. in ceramic material (alumina is preferred), is hollow and houses in its inside a heating element, which can be made e.g. by a metal wire resistor passing through the holes of a support being also made of ceramic material. The holes are parallel to the axis of the central support and are through-holes with respect thereto. The support 122 is typically fixed to a connector 124 provided with electrical feedthroughs, the connector being normally made of ceramic and fixed to one of the walls of the ion pump by brazing. The discs 121, 121', . . . may be formed of sintered powders of NEG materials and thus relatively compact, but they are preferably porous in order to increase the exposed surface area and hence the gas sorbing properties of the pump. Porous members of NEG material may be manufactured e.g. according to the process described in patent EP 719609 in the applicant's name, in the form of porous sintered bodies having various shapes such as described e.g. in patent U.S. Pat. No. 5,324,172 in the applicant's name, or also in the form of deposits on metal plates that may be differently shaped.

The ion pump 130 comprises an anode member 131 shaped as a cylindrical body having open ends and made of a conducting material, generally a metallic material, kept in position by a support 132 fixed to one of the walls of the ion pump by means of a connector 133 similar to connector 124 and provided with one or more electrical feedthroughs insulated from the flange. The axis of the anode member 131 is parallel to the flat surface of the flange. Two electrodes 134 and 134', made of titanium, tantalum or molybdenum, face the open ends of the anode member 131 and are arranged at a small distance (about 1 mm) from it. The assembly formed by the anode member 131 and the electrodes 134 and 134' is enclosed by walls 136. The poles 135 ad 135' of a permanent magnet face the sides on which the electrodes 134 and 134' are arranged. The magnet may be any known permanent magnet suitable to generate high magnetic fields, for example of the type neodymium-iron-boron or samarium-cobalt. The walls 136, that are closest to the electrodes 134 and 134' and parallel to them, preferably have a reduced thickness, e.g. having values between about 0.5 and 1.5 mm, in order not to shield the magnetic field generated by the magnet formed by poles 135 and 135'. The support 132 of the anode member 131 is a typical high-vacuum feedthrough in order to allow the passage of the electric supply to the anode member. It is possible that a single electric cable is present to supply the anode member 131, or there may also be electrical contacts allowing to read the pressure inside the vacuum chamber. The two electrodes may be kept at the potential of the flange; alternatively, they may be electrically supplied and kept at a same potential that is negative relative to the potential of the anode member 131. Alternatively, it is possible to electrically connect the two electrodes to each other by means of a contact (not shown in the drawings) that keeps them at the same potential.

Preferably, the ion pump 120 and the getter pump 130 are coaxially arranged with respect to each other, thus maximizing the sorption rate and the pumping efficiency of the combined system.

Moreover, the combined pumping system according to the present invention is preferably mounted on a chamber to be evacuated so that the getter pump is physically arranged inside the volume of the chamber and the ion pump is externally arranged with respect thereto.

In the preferred embodiment of the invention, an hollow element (170) comprising a plurality of lateral apertures formed along its walls is used corresponding the flange hole, as shown in FIG. 2*a*. This hollow element acts as a duct (but laterally opened) from the flange hole to the getter pump base, having side walls wherein at least a portion of the area is open. Different duct shapes and lateral openings can be indistinctly used in order to achieve the improvement of the present invention. For example the duct can have circular, squared, hexagonal or other geometrical cross-section. Moreover the openings can be holes, parallel slots or any other suitable alternative. Preferably the ratio between the empty area and the overall area of the duct is larger than 0.2, more preferably larger than 0.4. This solution allows to ensure a sufficient conductance between the chamber to be evacuated and the ion pump. Alternatively to a duct of the above-mentioned type, the system according to the invention may comprise any kind of metal structures laterally opened and suitable to support the members of the getter pump: as example a cage structure might be appropriately used. Although FIGS. 1, 2 and 2*a* show an ion pump in its simplest configuration, i.e. wherein a cylindrical anode is present, the anode members might be in a larger number than one. The ion pumps in the combined pumping system of the invention may have a very reduced size with respect to the size of the ion pumps used in the combined pumping systems of the prior art. In fact, thanks to the operation of the getter pump allowed by the configuration of the present invention, the ion pump may have nominal pumping speeds, for example, comprised between 2 and 20 l/sec.

In an alternative embodiment of the present invention, it is possible to use a magnet of the so-called "Alnico" type Alnico is an acronym indicating a composition based on aluminum (8-12% by weight), nickel (15-26%), cobalt (5-24%), with the possible addition of small percentages of copper and titanium, the residual part of the composition being iron. In addition to the ability of generating very high magnetic fields, Alnico magnets have one of the highest Curie point among all magnetic materials, around 800° C., thereby being able to withstand any thermal treatment the ion pump may undergo, and thus it is not necessary to remove the magnet when heating the system.

FIG. 3 shows an alternative embodiment of the invention, wherein a getter pump 220 comprises a plurality of getter members stacked on each other and arranged similarly to what is e.g. described in patent U.S. Pat. No. 6,149,392 in the applicant's name. The getter pump 220, which is arranged inside the walls 240 of a chamber to be evacuated, is enclosed by a perforated metal structure 250 coupled through a duct 270 inserted between the getter pump and a hole 260 of a flange 211 that, when the combined pumping system is in use, is mounted on a suitable hole along the walls 240 of a chamber to be evacuated. This communication duct 270 comprises a plurality of lateral apertures (not shown in the drawing) formed along its walls and that connect it with the chamber to be evacuated. This solution allows to ensure a sufficient conductance between the chamber to be evacuated and the ion pump. Alternatively to a duct of the above-mentioned type, the system according to the invention may comprise metal structures laterally open and suitable to support the members of the getter pump.

On the side of the flange opposite to the side where the getter pump is arranged, an ion pump 230 is arranged and coupled to the flange 211 at the hole 260 by duct 236. As explained above, the ion pump 230 may be provided with one or more anode members in its inside.

FIG. 4 shows a possible spatial arrangement of a number of getter members stacked inside the getter pump 220. Each getter member is represented by a series of discs 221 made of getter material stacked along a support 222 in a way similar to what has been already described for the simplest configuration of the integrated pump object of the invention. The different getter members forming the getter pump are arranged symmetrically around an axis coinciding with the center of the hole 260 present on the flange 211 of the integrated system. In addition, in one of the possible alternative embodiments of the invention, the hole of the flange may be characterized by the presence of a flat metal surface having one or more holes of a reduced size with respect to the actual hole of the flange, but such to ensure the pumping from the integrated system according to what is prescribed by the present invention. Alternatively, this flat perforated surface may correspond to the supporting plan of the getter pump formed of one or more getter members and thereby does not coincide with the surface occupied by the hole of the flange.

The technical advantages in terms of pumping of an integrated pump system deriving from their mutual positioning according to the present invention will be described in the following with reference to the following examples.

EXAMPLE 1

A combined pumping system according to the preferred embodiment of the present invention has been prepared, the system comprising a getter pump model CapaciTorr D-100 manufactured by the applicant and an ion pump having a nominal pumping speed of 2 l/sec. The pumps have been coaxially mounted with respect to each other and have been tested according to the ASTM F798-97 standard under conditions of a constant flux of methane of 2.12 $10^{-8}$ kg $m^2$ $s^{-3}$. The distance between the hole of the flange and the getter pump has been fixed at 24 mm. Table 1 sets forth the partial pressures that have been measured for the chemical species of methane and hydrogen, respectively.

EXAMPLE 2 (COMPARATIVE)

Under experimental conditions similar to those of the previous example, a combined pumping system not according to the present invention has been prepared, in which the getter pump and the ion pump have been arranged perpendicular to each other. The volume occupied by the getter pumps does not intercept the flange hole axis. The distance between the nearest getter pump element and the hole of the flange to which the ion pump is connected has been fixed at 38 mm.

EXAMPLE 3 (COMPARATIVE)

Under experimental conditions similar to those of the previous examples, a combined pumping system not according to the present invention has been prepared, in which the getter pump and the ion pump have their axes parallel and having about 130 mm distance from each other.

EXAMPLE 4 (COMPARATIVE)

Under experimental conditions similar to those of the previous examples, a combined pumping system according to the present invention has been prepared, in which, however, only the ion pump has been switched on.

Table 1 shows that the integrated pump according to the present invention has a pumping speed for methane higher than the pumping speed obtainable with different configurations of the same getter and ion pumps. In order to make a comparison, the table also contains the pumping speed in the case in which only the ion pump is used.

TABLE 1

| | Pressure $CH_4$ (Pa) | Pressure $H_2$ (Pa) | Pumping speed/pumping speed of integrated solution |
|---|---|---|---|
| Example 1 | $1.72 * 10^{-6}$ | $1.73 * 10^{-7}$ | 1.00 |
| Example 2 | $2.24 * 10^{-6}$ | $2.12 * 10^{-7}$ | 0.77 |
| Example 3 | $2.49 * 10^{-6}$ | $4.52 * 10^{-7}$ | 0.64 |
| Example 4 | $2.20 * 10^{-6}$ | $7.80 * 10^{-6}$ | 0.19 |

EXAMPLE 5

A combined pumping system according to the present invention has been prepared, the system comprising a getter pump model CapaciTorr D-100 manufactured by the applicant and an ion pump having a nominal flux rate of 2 l/sec. The pumps have been coaxially mounted with respect to each other and have been tested according to the ASTM F798-97 standard under conditions of a constant flux of Argon of $2.7*10^{-9}$ kg $m^2$ $s^{-3}$. The shortest distance between the hole of the flange and the getter pump has been fixed at 24 mm. Table 2 sets forth the partial pressures that have been measured for the chemical species of Argon and Hydrogen, respectively when dynamical pressure equilibrium has been achieved in the measuring chamber.

EXAMPLE 6

Under experimental conditions similar to those of the previous example, a combined pumping system according to the present invention has been prepared, in which the minimum distance between the getter pump and the hole of the flange to which the ion pump is connected has been fixed at 60 mm.

TABLE 2

| | Pressure Ar (Pa) | Pressure $H_2$ (Pa) |
|---|---|---|
| Example 5 | $2.40 * 10^{-6}$ | $4.16 * 10^{-8}$ |
| Example 6 | $2.40 * 10^{-6}$ | $5.33 * 10^{-8}$ |

Table 2 shows that the integrated pump according to the present invention has pumping efficiency respect the hydrogen generated by the ion pump in presence of Argon.

In a secondary aspect thereof the combined system of the present invention has the additional technical advantage of a reduced volumetric size with respect to what is described by the prior art. By way of example, in applications requiring chambers to be evacuated having a size similar to the size of the chambers typically used in electronic microscopy, due to the reduced size of the two pumps the system of the invention may be fixed e.g. on a single circular flange having a diameter of 70 mm (known in the field as CF 40), or on flanges having a different shape but substantially the same surface area. The flange is made of materials known in the field, for example AISI 316 L or AISI 304 L steel. Preferably, the central hole of the flange, which connects the ion pump with the evacuated chamber as well as with the getter pump of the integrated system has a diameter comprised between 10 and 40 mm.

Finally, the combined system of the present invention has the advantage that the getter pump elements can physically block the sputtered titanium particles that can be generated by the ion pump during its working Therefore the combined system is a useful one in order to minimize the particle dust in many applications, as for example in accelerator vacuum systems.

The invention claimed is:

1. A combined pumping system, comprising a getter pump and an ion pump mounted in series and respectively arranged on opposite sides of a same flange, the ion pump connected to a flange hole of the flange by a duct, wherein the flange is suitable to directly mount the combined pumping system to a wall of a vacuum chamber and the getter pump is external to the duct connecting the ion pump to the flange hole.

2. The system according to claim 1, wherein a volume of the getter pump intercepts an axis of symmetry of the flange hole.

3. The system according to claim 1, wherein said pumps are mounted axially parallel to each other and to an axis of symmetry of the flange hole.

4. The system according to claim 1, wherein said pumps are coaxially mounted with respect to each other.

5. The system according to claim 1, wherein the getter pump further comprises a plurality of discs made of a non-evaporable getter material stacked on one or more supports.

6. The system according to claim 5, wherein said getter material discs are arranged inside a metal structure coupled to the flange hole of the flange through a second duct suitable to connect the getter pump with the ion pump.

7. The system according to the claim 6, wherein said second duct is provided with walls having a plurality of side apertures suitable to directly connect the vacuum chamber to the ion pump.

8. The system according to claim 7, wherein in the second duct the plurality of side apertures are provided such that a ratio between an area of the apertures and an overall lateral area is larger than 0.2.

9. The system according to claim 7, wherein in the second duct the plurality of side apertures are provided such that a ratio between an area of the apertures and an overall lateral area is larger than 0.4.

10. The system according to the claim 6, wherein said second duct has a cage-like structure.

11. The system according to claim 5, wherein said getter material discs are arranged inside a metal structure coupled to the flange hole of the flange, the metal structure laterally opened and suitable to support the the getter pump.

* * * * *